US010481549B2

(12) United States Patent
Nohara

(10) Patent No.: US 10,481,549 B2
(45) Date of Patent: Nov. 19, 2019

(54) ATTACHMENT UNIT

(71) Applicant: KYOCERA Document Solutions Inc., Osaka (JP)

(72) Inventor: Yuta Nohara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/248,825

(22) Filed: Jan. 16, 2019

(65) Prior Publication Data

US 2019/0235438 A1 Aug. 1, 2019

(30) Foreign Application Priority Data

Jan. 26, 2018 (JP) ..... 2018-011178

(51) Int. Cl.
*G03G 21/16* (2006.01)

(52) U.S. Cl.
CPC ..... *G03G 21/1604* (2013.01)

(58) Field of Classification Search
CPC ..... G03G 21/1604; G03G 21/1647; G03G 21/1821
See application file for complete search history.

(56) References Cited

U.S. PATENT DOCUMENTS 5,530,531 A * 6/1996 Girard ..... B41J 2/1755 222/DIG. 1
7,287,998 B2 10/2007 Masai
7,747,209 B2 * 6/2010 Yamazaki ..... G03G 21/1619 312/110
2004/0264998 A1 * 12/2004 Uchida ..... G03G 15/6511 399/107
2006/0248733 A1 11/2006 Masai
2013/0195504 A1 * 8/2013 Park ..... G03G 21/1661 399/107
2014/0198169 A1 * 7/2014 Sugiyama ..... B41J 2/447 347/138
2014/0212167 A1 * 7/2014 Agata ..... G03G 21/1647 399/107
2014/0348560 A1 * 11/2014 Matsuno ..... G03G 21/1619 399/343
2017/0038726 A1 * 2/2017 Agata ..... G03G 21/1647
2017/0108818 A1 * 4/2017 Hashimoto ..... G03G 21/1619
2018/0101122 A1 * 4/2018 Tokumoto ..... G03G 21/1604

FOREIGN PATENT DOCUMENTS

JP 2006-313252 A 11/2006

* cited by examiner

*Primary Examiner* — Sevan A Aydin
(74) *Attorney, Agent, or Firm* — Studebaker & Brackett PC

(57) ABSTRACT

An attachment unit for attaching a second device to a first device includes a first attachment member and a second attachment member. Each of the first attachment member and the second attachment member has first to Nth engagement sections. N is an integer of at least 2. The first to Nth engagement sections of the first attachment member respectively have the same shape as the first to Nth engagement sections of the second attachment member. The nth engagement section of the first attachment member is engageable with the (N−n+1)th engagement section of the second attachment member. n is an integer of at least 1 and no greater than N. At least one of the first device and the second device is an image forming apparatus or an extension device.

13 Claims, 12 Drawing Sheets

ATTACHMENT UNIT

INCORPORATION BY REFERENCE

The present application claims priority under 35 U.S.C. § 119 to Japanese Patent Application No. 2018-011178, filed on Jan. 26, 2018. The contents of this application are incorporated herein by reference in their entirety.

BACKGROUND

The present disclosure relates to an attachment unit.

A known connection device connects a post-processing device to a main body of an image forming apparatus. The connection device includes a fixed locking member and a movable locking member. The fixed locking member is connected to a first frame of the post-processing device. The movable locking member is in contact with an outer face of the fixed locking member and is slidable. A positioning pin fixed to a second frame of a copier, which is an example of the image forming apparatus, is inserted in a pin insertion hole and a large diameter portion in the movable locking member in an unlock position. The positioning pin engages with and is fixed to a small diameter portion in the movable locking member when the movable locking member is moved to slide to a lock position with the positioning pin in the pin insertion hole.

SUMMARY

An attachment unit according to an aspect of the present disclosure attaches a second device to a first device. The attachment unit includes a first attachment member and a second attachment member. The first attachment member is attachable to the first device. The second attachment member is attachable to the second device. Each of the first attachment member and the second attachment member has first to Nth engagement sections arranged in the stated order. N is an integer of at least 2. The first to Nth engagement sections of the first attachment member respectively have the same shape as the first to Nth engagement sections of the second attachment member. The nth engagement section of the first attachment member is engageable with the (N−n+1)th engagement section of the second attachment member. n is an integer of at least 1 and no greater than N. At least one of the first device and the second device is an image forming apparatus having an image formation function of forming images on sheets or an extension device having a function of extending the image formation function.

DETAILED DESCRIPTION

Figure 1:
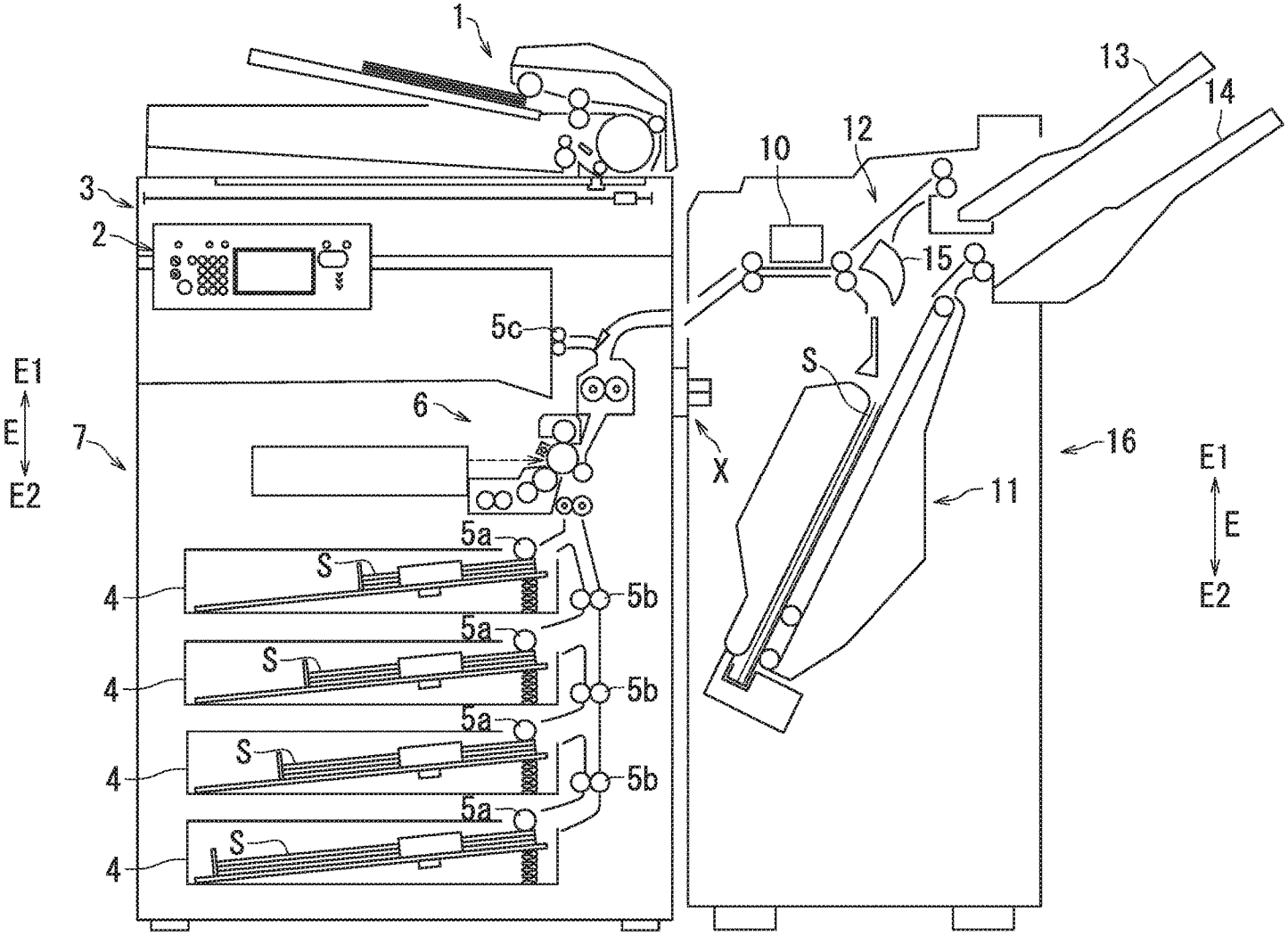
FIG. 1 is a diagram illustrating an example of a use of an attachment unit according to an embodiment of the present disclosure.

The following describes an embodiment of the present disclosure with reference to the accompanying drawings. Note that elements in the drawings that are the same or equivalent are labelled using the same reference signs and description thereof is not repeated.

The following describes an attachment unit X according to the embodiment of the present disclosure with reference to FIG. 1. FIG. 1 is a diagram illustrating an example of a use of the attachment unit X.

As illustrated in FIG. 1, the attachment unit X is a device for attaching a post-processing device 102 to an image forming apparatus 101.

The image forming apparatus 101 is for example a multifunction peripheral (MFP). The image forming apparatus 101 for example has functions of a scanner, a copier, a printer, and a facsimile machine (FAX).

The image forming apparatus 101 includes a feeder 1, an input section 2, a reader 3, cassettes 4, sheet feed rollers 5*a*, conveyance rollers 5*b*, an ejection roller 5*c*, an image forming section 6, and a first housing 7.

The feeder 1 conveys a sheet having a scan target image thereon to the reader 3. The reader 3 scans the sheet to acquire image data. The reader 3 for example includes a light emitting section such as one including light emitting diodes (LEDs) and an imaging section such as an image sensor. The image is scanned from the sheet through the light emitting section and the imaging section. The input section 2 includes a display section and a set of operation keys. The input section 2 receives an instruction from a user to the image forming apparatus 101. The display section functions as a touch panel.

The cassettes 4 each accommodate sheets S. The sheets S are for example plain paper, recycled paper, thin paper, thick paper, or overhead projector (OHP) sheets. Each of the sheet feed rollers 5*a* feeds a sheet S from a corresponding one of the cassettes 4. The conveyance rollers 5*b* then forward the sheet S fed by the sheet feed roller 5*a* to the image forming section 6.

The image forming section 6 forms an image on the sheet S. Specifically, the image is a toner image. The image forming section 6 includes a photosensitive drum, a charger, a light exposure section, a developing section, a transfer section, a cleaner, and a static eliminating section. The photosensitive drum, the charger, the light exposure section, the developing section, and the transfer section are used to form the image on the sheet S. The cleaner removes toner remaining on a surface of the photosensitive drum. The static eliminating section eliminates residual charge from the surface of the photosensitive drum. After forming the image on the sheet S, the image forming section 6 forwards the sheet S to a fixing section. The fixing section applies heat and pressure to the image to fix the image to the sheet S. Note that the image forming section 6 may have nozzles and form the image on the sheet S by ejecting ink from the nozzles.

After the sheet S has passed through the image forming section 6, the ejection roller 5*c* ejects the sheet S out of the first housing 7 of the image forming apparatus 101.

The first housing 7 houses the cassettes 4, the sheet feed rollers 5*a*, the conveyance rollers 5*b*, the ejection roller 5*c*, and the image forming section 6.

The post-processing device 102 performs specific post-processing on sheets S having images formed thereon by the image forming apparatus 101. The post-processing device 102 according to the present embodiment performs either or both of a punching process and a stapling process. The punching process is to form a punch hole in the sheets S. The stapling process is to bind a sheaf of the sheets S with a binding tool such as a staple.

The post-processing device 102 includes a punching section 10, a stapling section 11, a sheet conveyance mechanism 12, a first exit tray 13, a second exit tray 14, a diverging guide 15, and a second housing 16.

The sheet conveyance mechanism 12 conveys a sheet S conveyed thereto from the image forming apparatus 101. The sheet conveyance mechanism 12 includes a plurality of rollers and a driving source for causing rotation of the rollers. The driving source for example includes a motor and gears.

The punching section 10 performs the punching process on the sheet S conveyed thereto. The punching process is not performed on any sheet S that is not a target of the punching process. The sheet S that has passed through the punching section 10 is conveyed to the diverging guide 15.

The diverging guide 15 switches a conveyance direction of the sheet S conveyed thereto from the punching section 10 between a direction toward the first exit tray 13 and a direction toward the stapling section 11. The sheet S that has passed through the diverging guide 15 is ejected onto the first exit tray 13 or subjected to the stapling process by the stapling section 11 according to a result of the switching. A sheaf of sheets S subjected to the stapling process is ejected onto the second exit tray 14.

The second housing 16 houses the punching section 10, the stapling section 11, the sheet conveyance mechanism 12, and the diverging guide 15.

The attachment unit X is located between the image forming apparatus 101 and the post-processing device 102. Specifically, the attachment unit X is located between the first housing 7 and the second housing 16. The attachment unit X includes a first attachment member X1 and a second attachment member X2.

Figure 2A:
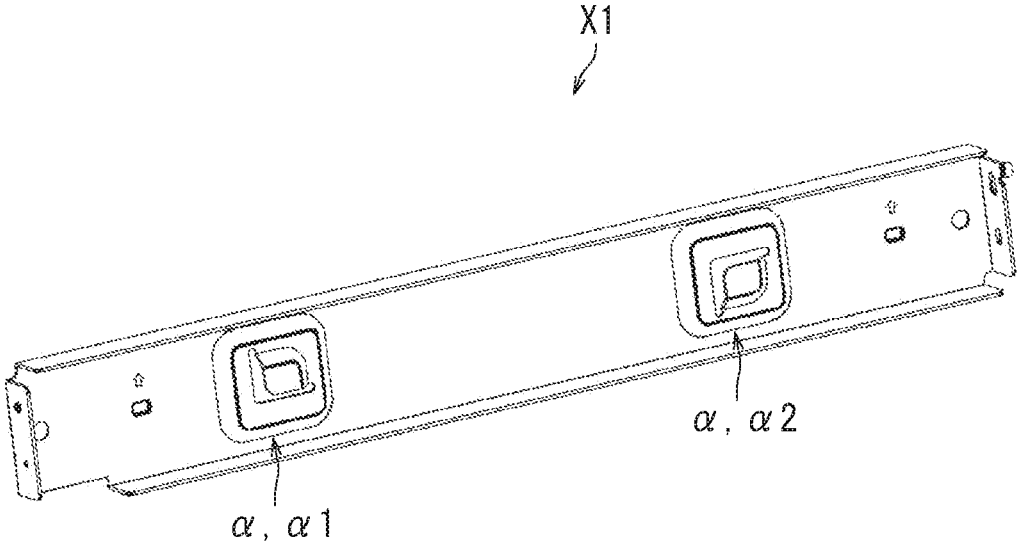
FIG. 2A is a perspective view of a first attachment member.
Figure 2B:
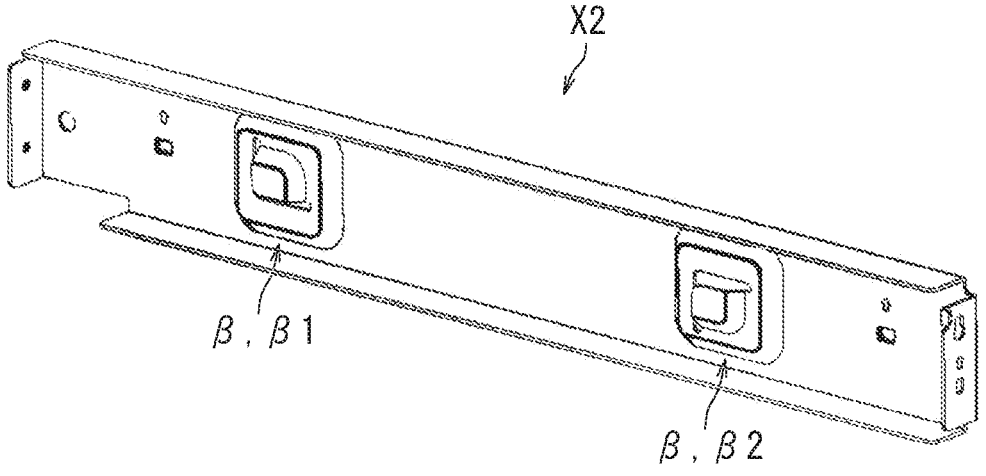
FIG. 2B is a perspective view of a second attachment member.

The following describes the first and second attachment members X1 and X2 with reference to FIGS. 2A and 2B. FIG. 2A is a perspective view of the first attachment member X1. FIG. 2B is a perspective view of the second attachment member X2.

As illustrated in FIG. 2A, the first attachment member X1 is attachable to the image forming apparatus 101 (see FIG. 1). The first attachment member X1 includes a plurality of engagement sections α. The engagement sections α include a first distal engagement section α1 and a first proximal engagement section α2.

As illustrated in FIG. 2B, the second attachment member X2 is attachable to the post-processing device 102 (see FIG. 1). The second attachment member X2 includes a plurality of engagement sections β. The engagement sections β include a second distal engagement section β1 and a second proximal engagement section β2. The second distal engagement section β1 is engageable with the first proximal engagement section α2. The second proximal engagement section β2 is engageable with the first distal engagement section α1.

As illustrated in FIGS. 2A and 2B, the first attachment member X1 and the second attachment member X2 have the same shape. The first distal engagement section α1 and the second distal engagement section β1 have the same shape. The first proximal engagement section α2 and the second proximal engagement section β2 have the same shape.

First, the first attachment member X1 is attached to the image forming apparatus 101 and the second attachment member X2 is attached to the post-processing device 102. Thereafter, the first distal engagement section al and the second proximal engagement section β2 engage with each other, and the first proximal engagement section α2 and the second distal engagement section β1 engage with each other. As a result, the post-processing device 102 is attached to the image forming apparatus 101. Note that the post-processing device 102 being attached to the image forming apparatus 101 specifically means the post-processing device 102 being attached to the image forming apparatus 101 through the attachment unit X.

Figure 3:
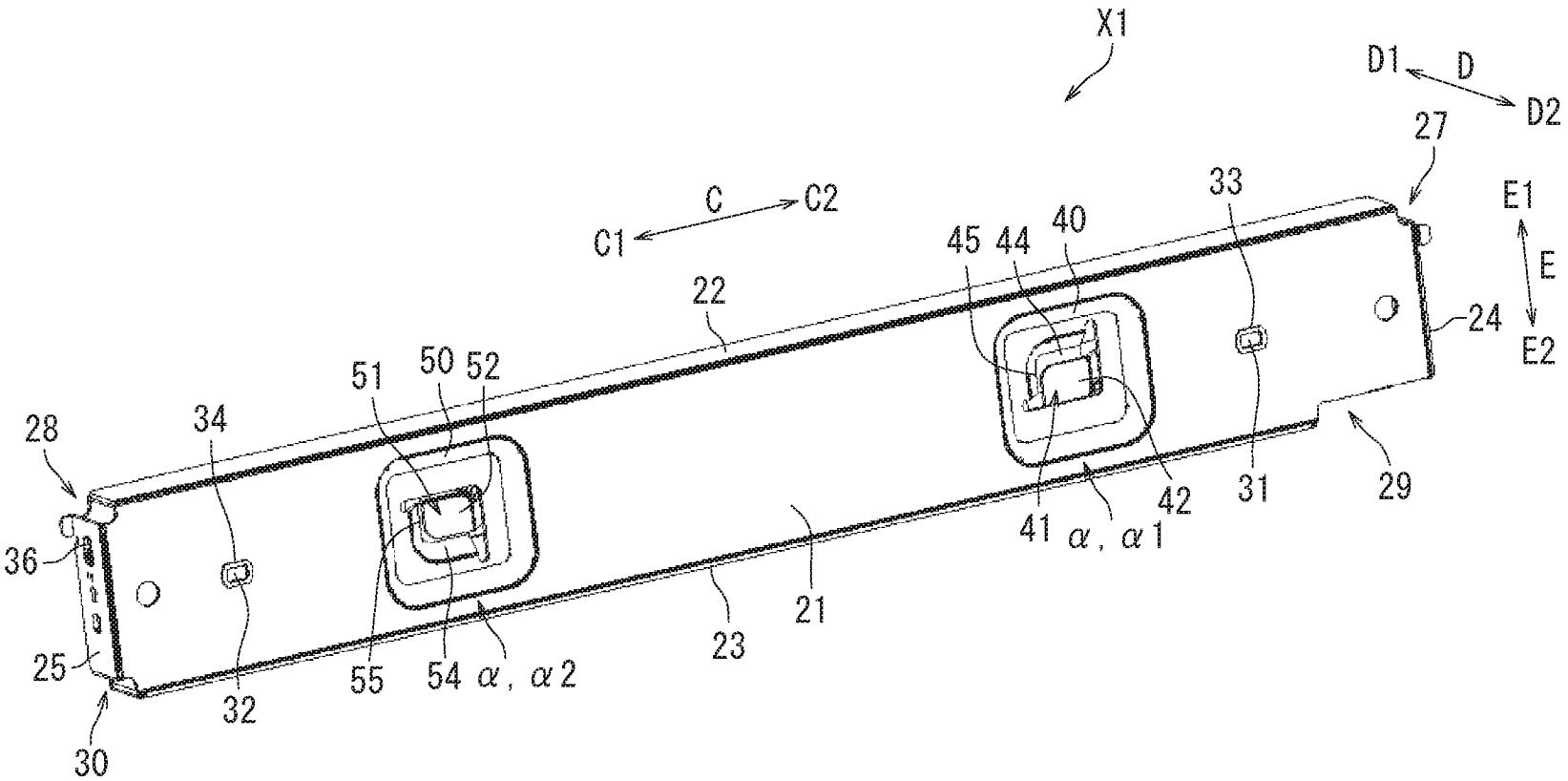
FIG. 3 is a perspective view of one side of the first attachment member.
Figure 4:
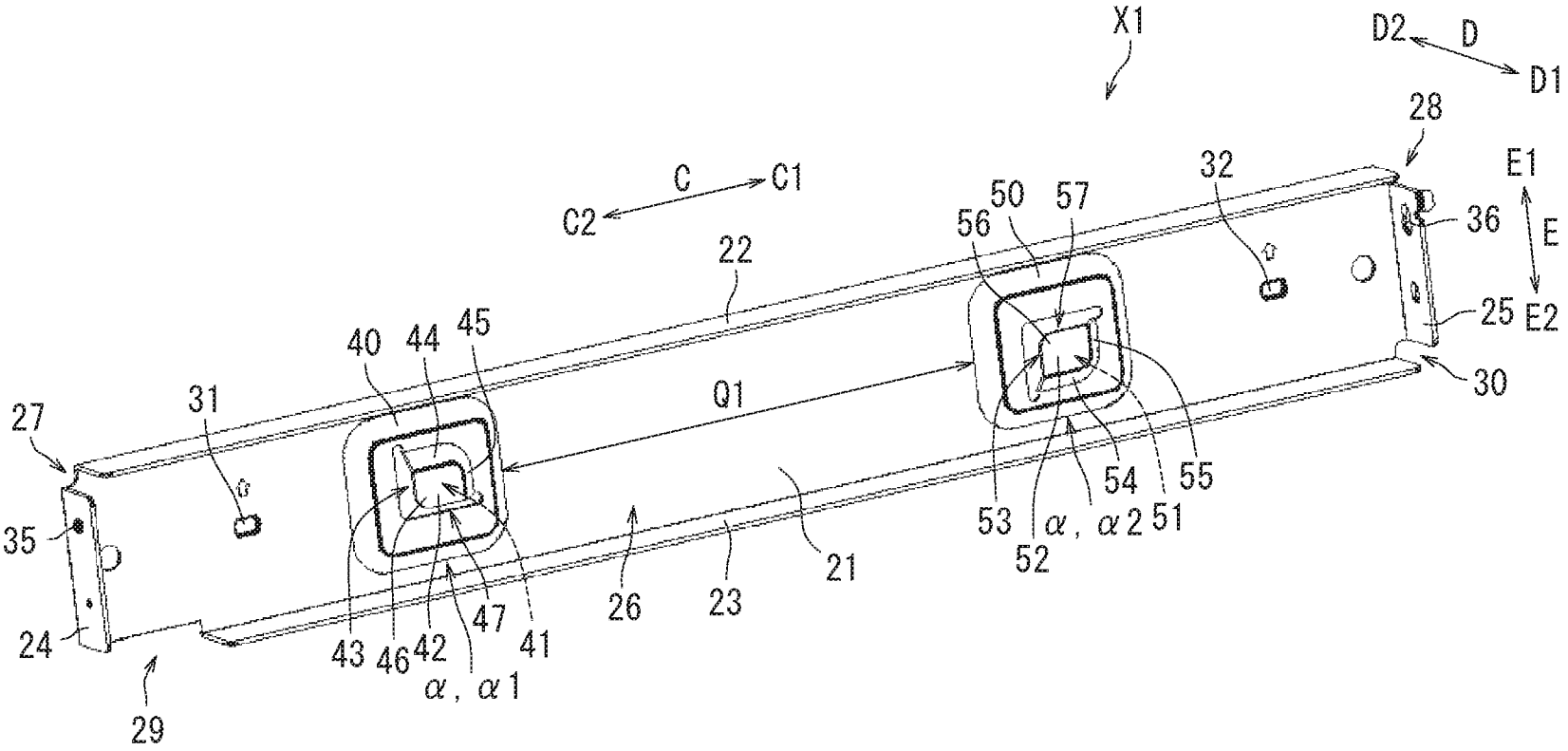
FIG. 4 is a perspective view of another side of the first attachment member.

The following describes the first attachment member X1 with reference to FIGS. 3 and 4. FIG. 3 is a perspective view of one side of the first attachment member X1. FIG. 4 is a perspective view of another side of the first attachment member X1. The other side means a side opposite to the one side.

FIGS. 3 and 4 show a first direction C, a second direction D, and a third direction E. The second direction D is orthogonal to the first direction C. The third direction E is orthogonal both to the first direction C and to the second direction D.

As illustrated in FIGS. 3 and 4, the first attachment member X1 has a first side part 21, a first top part 22, a first bottom part 23, a first distal end part 24, and a first proximal end part 25. The first side part 21, the first top part 22, the first bottom part 23, the first distal end part 24, and the first proximal end part 25 are each formed from a metal, for example.

The first side part 21 has a plate-like shape. The first side part 21 has a flat surface substantially parallel to the third direction E. The first side part 21 extends in the first direction C.

The first top part 22 has a plate-like shape. The first top part 22 of the first attachment member X1 is located at one end E1 in the third direction E. The first top part 22 protrudes toward one end D1 in the second direction D. The first top part 22 extends in the first direction C. The first top part 22 is located at an edge of the first side part 21 at the one end E1 in the third direction E.

The first bottom part 23 has a plate-like shape. The first bottom part 23 of the first attachment member X1 is located at an opposite end E2 in the third direction E. The first bottom part 23 protrudes toward the one end D1 in the second direction D. The first bottom part 23 extends in the first direction C. The first bottom part 23 is opposed to the first top part 22. The first bottom part 23 is located at an edge of the first side part 21 at the opposite end E2 in the third direction E.

The first proximal end part 25 has a plate-like shape. The first proximal end part 25 of the first attachment member X1 is located at one end C1 in the first direction C. The first proximal end part 25 protrudes toward the one end D1 in the second direction D. The first proximal end part 25 extends in the third direction E. The first proximal end part 25 is opposed to the first distal end part 24. The first proximal end part 25 is located at an edge of the first side part 21 at the one end C1 in the first direction C.

The first distal end part 24 has a plate-like shape. The first distal end part 24 of the first attachment member X1 is located at an opposite end C2 in the first direction C. The first distal end part 24 protrudes toward the one end D1 in the second direction D. The first distal end part 24 extends in the third direction E. The first distal end part 24 is located at an edge of the first side part 21 at the opposite end C2 in the first direction C.

A space surrounded by the first side part 21, the first top part 22, the first bottom part 23, the first distal end part 24, and the first proximal end part 25 is referred to as a first space 26. The first space 26 is located farther toward the one end D1 in the second direction D than the first side part 21.

The first top part 22 and the first distal end part 24 have a first distal top gap 27 therebetween. The first top part 22 and the first proximal end part 25 have a first proximal top gap 28 therebetween. The first bottom part 23 and the first distal end part 24 have a first distal bottom gap 29 therebetween. The first bottom part 23 and the first proximal end part 25 have a first proximal bottom gap 30 therebetween. The first distal top gap 27, the first proximal top gap 28, the first distal bottom gap 29, and the first proximal bottom gap 30 each provide communication between the first space 26 and the outside of the first space 26.

The first distal engagement section $\alpha$1 and the first proximal engagement section $\alpha$2 are arranged in the first direction C. The first proximal engagement section $\alpha$2 is located farther toward the one end C1 in the first direction C than the first distal engagement section $\alpha$1. The first distal engagement section al and the first proximal engagement section $\alpha$2 are in the first space 26.

The first attachment member X1 further has a first distal attachment hole 31, a first proximal attachment hole 32, a first distal positioning protrusion 33, a first proximal positioning protrusion 34, a first boss 35, and a first engagement hole 36.

The first distal attachment hole 31 and the first proximal attachment hole 32 are each a hole for attachment of the first attachment member X1 to the image forming apparatus 101. The first distal attachment hole 31 and the first proximal attachment hole 32 each penetrate the first side part 21. The first distal attachment hole 31 is located farther toward the opposite end C2 in the first direction C than the first proximal attachment hole 32.

The first distal positioning protrusion 33 and the first proximal positioning protrusion 34 are each a protrusion for positioning of the first attachment member X1 relative to the image forming apparatus 101. The first distal positioning protrusion 33 and the first proximal positioning protrusion 34 are ring-shaped along peripheries of the first distal attachment hole 31 and the first proximal attachment hole 32, respectively, and protrude toward an opposite end D2 in the second direction D.

The first boss 35 is a protrusion for positioning of the first attachment member X1 and the second attachment member X2 relative to each other. The first boss 35 is on the first distal end part 24. The first boss 35 protrudes from the first distal end part 24 toward the opposite end C2 in the first direction C.

The first engagement hole 36 is a hole for positioning of the first attachment member X1 and the second attachment member X2 relative to each other. The first engagement hole 36 is located in the first proximal end part 25. The first engagement hole 36 penetrates the first proximal end part 25.

The following describes the first distal engagement section al with reference to FIGS. 3 and 4.

The first distal engagement section al has a first distal raised portion 40, a first distal void 41, a first distal cover 42, a first distal opening 43, a first top plate 44, a first distal wall 45, a first distal protrusion 46, and a first bottom opening 47.

The first distal raised portion 40 is raised from the first side part 21 toward the one end D1 in the second direction D.

The first distal void 41 is an empty space. The first distal void 41 is located farther toward the one end D1 in the second direction D than the first side part 21. The first distal void 41 is within the first space 26. The first distal void 41 is located farther toward the one end D1 in the second direction D than the first distal raised portion 40.

The first distal cover 42 has a plate-like shape. The first distal cover 42 is located farther toward the one end D1 in the second direction D than the first distal void 41. The first distal cover 42 covers the first distal void 41 from the one end D1 in the second direction D. The first distal cover 42 is within the first space 26.

The first distal opening 43 opens the first distal void 41 at the opposite end C2 in the first direction C. The first distal opening 43 is located farther toward the opposite end C2 in the first direction C than the first distal void 41. The first distal opening 43 provides communication between the first distal void 41 and the outside of the first distal void 41.

The first top plate 44 covers the first distal void 41 from the one end E1 in the third direction E. The first top plate 44 is located between the first distal raised portion 40 and the first distal cover 42.

The first distal wall 45 covers the first distal void 41 from the one end C1 in the first direction C. The first distal wall 45 is located between the first distal raised portion 40 and the first distal cover 42. The first distal wall 45 is continuous from the first top plate 44.

The first distal protrusion 46 is located at an edge of the first distal cover 42 at the opposite end C2 in the first direction C. The first distal protrusion 46 extends from the first distal cover 42 toward the opposite end C2 in the first direction C and protrudes toward the one end D1 in the second direction D.

The first bottom opening 47 opens the first distal void 41 at the opposite end E2 in the third direction E. The first bottom opening 47 is located farther toward the opposite end E2 in the third direction E than the first distal void 41. The first bottom opening 47 provides communication between the first distal void 41 and the outside of the first distal void 41.

The following describes the first proximal engagement section α2 with reference to FIGS. 3 and 4.

The first proximal engagement section α2 has a first proximal raised portion 50, a first proximal void 51, a first proximal cover 52, a first proximal opening 53, a first bottom plate 54, a first proximal wall 55, a first proximal protrusion 56, and a first top opening 57.

The first proximal raised portion 50 is raised from the first side part 21 toward the one end D1 in the second direction D.

The first proximal void 51 is an empty space. The first proximal void 51 is located farther toward the one end D1 in the second direction D than the first side part 21. The first proximal void 51 is within the first space 26. The first proximal void 51 is located farther toward the one end D1 in the second direction D than the first proximal raised portion 50.

The first proximal cover 52 has a plate-like shape. The first proximal cover 52 is located farther toward the one end D1 in the second direction D than the first proximal void 51. The first proximal cover 52 covers the first proximal void 51 from the one end D1 in the second direction D. The first proximal cover 52 is within the first space 26.

The first proximal opening 53 opens the first proximal void 51 at the opposite end C2 in the first direction C. The first proximal opening 53 is located farther toward the opposite end C2 in the first direction C than the first proximal void 51. The first proximal opening 53 provides communication between the first proximal void 51 and the outside of the first proximal void 51.

The first bottom plate 54 covers the first proximal void 51 from the opposite end E2 in the third direction E. The first bottom plate 54 is located between the first proximal raised portion 50 and the first proximal cover 52.

The first proximal wall 55 covers the first proximal void 51 from the one end C1 in the first direction C. The first proximal wall 55 is located between the first proximal raised portion 50 and the first proximal cover 52. The first proximal wall 55 is continuous from the first bottom plate 54.

The first proximal protrusion 56 is located at an edge of the first proximal cover 52 at the opposite end C2 in the first direction C. The first proximal protrusion 56 extends from the first proximal cover 52 toward the opposite end C2 in the first direction C and protrudes toward the one end D1 in the second direction D.

The first top opening 57 opens the first proximal void 51 at the one end E1 in the third direction E. The first top opening 57 is located farther toward the one end E1 in the third direction E than the first proximal void 51. The first top opening 57 provides communication between the first proximal void 51 and the outside of the first proximal void 51.

Figure 5:
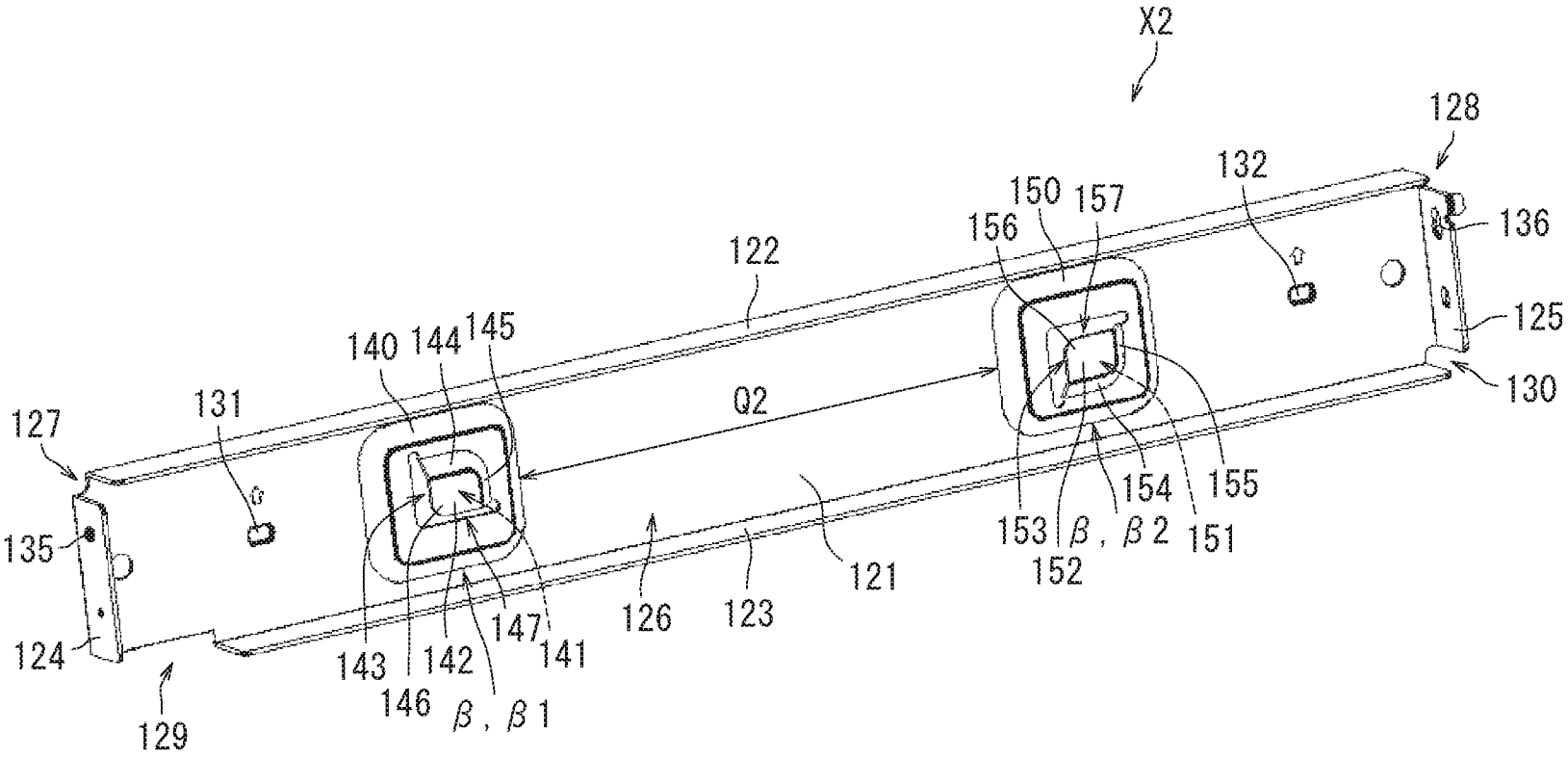
FIG. 5 is a perspective view of the second attachment member.

The following describes the second attachment member X2 with reference to FIGS. 4 and 5. FIG. 5 is a perspective view of the second attachment member X2.

As illustrated in FIGS. 4 and 5, the second attachment member X2 has the same shape as the first attachment member X1.

As illustrated in FIG. 5, the second attachment member X2 has a second side part 121, a second top part 122, a second bottom part 123, a second distal end part 124, and a second proximal end part 125. A space surrounded by the second side part 121, the second top part 122, the second bottom part 123, the second distal end part 124, and the second proximal end part 125 is referred to as a second space 126.

The second side part 121 illustrated in FIG. 5 is equivalent to the first side part 21 illustrated in FIG. 4. The second top part 122 is equivalent to the first top part 22. The second bottom part 123 is equivalent to the first bottom part 23. The second distal end part 124 is equivalent to the first distal end part 24. The second proximal end part 125 is equivalent to the first proximal end part 25. The second space 126 is equivalent to the first space 26.

As illustrated in FIG. 5, the second attachment member X2 has a second distal top gap 127, a second proximal top gap 128, a second distal bottom gap 129, and a second proximal bottom gap 130.

The second distal top gap 127 illustrated in FIG. 5 is equivalent to the first distal top gap 27 illustrated in FIG. 4. The second proximal top gap 128 is equivalent to the first proximal top gap 28. The second distal bottom gap 129 is equivalent to the first distal bottom gap 29. The second proximal bottom gap 130 is equivalent to the first proximal bottom gap 30.

As illustrate in FIG. 5, the second attachment member X2 further has a second distal attachment hole 131, a second proximal attachment hole 132, a second distal positioning protrusion 133, a second proximal positioning protrusion 134, a second boss 135, and a second engagement hole 136.

The second distal attachment hole 131 is equivalent to the first distal attachment hole 31 illustrated in FIG. 4. The second proximal attachment hole 132 is equivalent to the first proximal attachment hole 32. The second distal positioning protrusion 133 is equivalent to the first distal positioning protrusion 33. The second proximal positioning protrusion 134 is equivalent to the first proximal positioning protrusion 34. The second boss 135 is equivalent to the first boss 35. The second engagement hole 136 is equivalent to the first engagement hole 36.

As illustrated in FIG. 5, the second distal engagement section β1 has a second distal raised portion 140, a second distal void 141, a second distal cover 142, a second distal opening 143, a second top plate 144, a second distal wall 145, a second distal protrusion 146, and a second bottom opening 147.

The second distal engagement section β1 illustrated in FIG. 5 is equivalent to the first distal engagement section α1 illustrated in FIG. 4. The second distal raised portion 140 is equivalent to the first distal raised portion 40. The second distal void 141 is equivalent to the first distal void 41. The second distal cover 142 is equivalent to the first distal cover 42. The second distal opening 143 is equivalent to the first distal opening 43. The second top plate 144 is equivalent to the first top plate 44. The second distal wall 145 is equivalent to the first distal wall 45. The second distal protrusion 146 is equivalent to the first distal protrusion 46. The second bottom opening 147 is equivalent to the first bottom opening 47.

The second proximal engagement section β2 has a second proximal raised portion 150, a second proximal void 151, a second proximal cover 152, a second proximal opening 153, a second bottom plate 154, a second proximal wall 155, a second proximal protrusion 156, and a second top opening 157.

The second proximal engagement section β2 is equivalent to the first proximal engagement section 112 illustrated in FIG. 4. The second proximal raised portion 150 is equivalent to the first proximal raised portion 50. The second proximal void 151 is equivalent to the first proximal void 51. The second proximal cover 152 is equivalent to the first proximal cover 52. The second proximal opening 153 is equivalent to the first proximal opening 53. The second bottom plate 154 is equivalent to the first bottom plate 54. The second proximal wall 155 is equivalent to the first proximal wall 55. The second proximal protrusion 156 is equivalent to the first proximal protrusion 56. The second top opening 157 is equivalent to the first top opening 57.

As illustrated in FIGS. 4 and 5, a distance Q1 between the first distal engagement section α1 and the first proximal engagement section α2 is equal to a distance Q2 between the second distal engagement section β1 and the second proximal engagement section β2 (Q1=Q2).

As described above with reference to FIGS. 4 and 5, the first attachment member X1 and the second attachment member X2 have the same shape. It is therefore possible to form the attachment unit X into a simple shape. It is also possible to use a single mold to manufacture both the first and second attachment members X1 and X2. As a result, manufacture of the attachment unit X is easy.

The first distal engagement section α1 and the second distal engagement section β1 have the same shape, and the first proximal engagement section α2 and the second proximal engagement section β2 have the same shape. Thus, a device for attachment of the post-processing device 102 to the image forming apparatus 101 can have a simple shape.

Figure 6A:
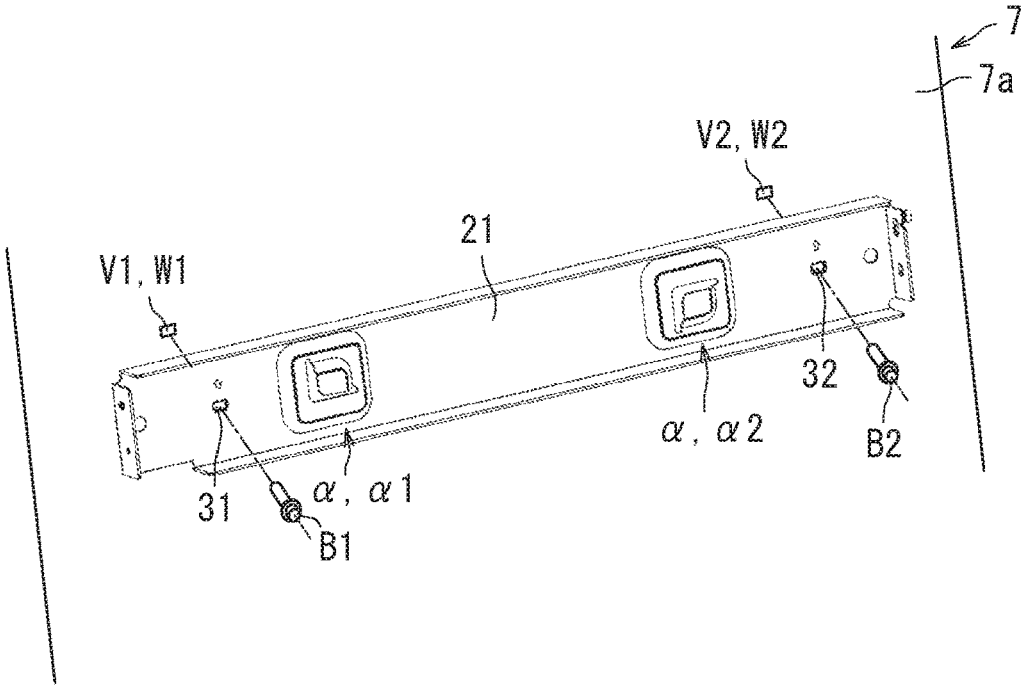
FIG. 6A is a perspective view of the first attachment member and an image forming apparatus.
Figure 6B:
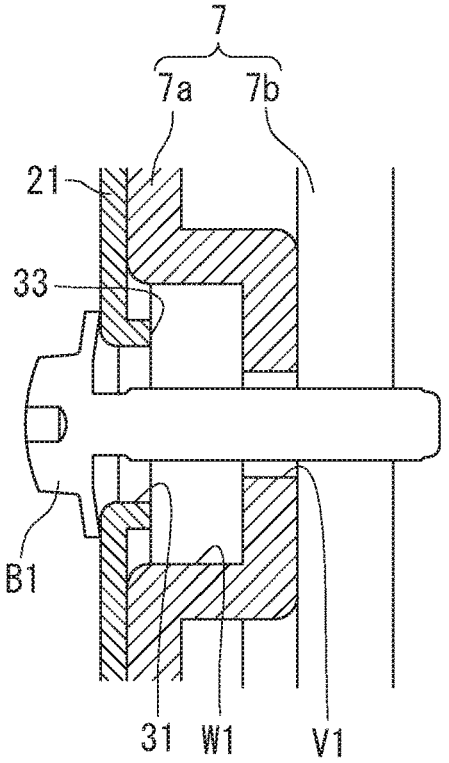
FIG. 6B is a cross-sectional view of the first attachment member attached to the image forming apparatus.

The following describes steps for attaching the first attachment member X1 to the image forming apparatus 101 with reference to FIGS. 6A and 6B. FIG. 6A is a perspective view of the first attachment member X1 and the image forming apparatus 101. FIG. 6B is a cross-sectional view of the first attachment member X1 attached to the image forming apparatus 101.

As illustrated in FIGS. 6A and 6B, the first housing 7 has a first outer covering 7*a* and a first frame 7*b*. The first outer covering 7*a* constitutes an exterior of the first housing 7. The first outer covering 7*a* is for example formed from a resin. The first frame 7*b* is disposed inside of the first housing 7. The first frame 7*b* is for example formed from a metal. A first hole V1, a second hole V2, a first recess W1, and a second recess W2 are formed through an outer surface of the first housing 7. Specifically, the first hole V1, the second hole V2, the first recess W1, and the second recess W2 are formed in the first outer covering 7*a*.

The first attachment member X1 is positioned relative to the first housing 7 for example through the first distal positioning protrusion 33 engaging with the first recess W1 and the first proximal positioning protrusion 34 engaging with the second recess W2. The first attachment member X1 is then attached to the image forming apparatus 101 through a first fastener B1 being inserted in the first distal attachment hole 31 and the first hole V1, and a second fastener B2 being inserted in the first proximal attachment hole 32 and the second hole V2. The first fastener B1 and the second fastener B2 are for example screws.

According to the present embodiment, the first attachment member X1 is attached to the first outer covering 7*a*. Specifically, the first attachment member X1, the first outer covering 7*a*, and the first frame 7*b* are tightened together and fixed to one another by the first and second fasteners B1 and B2. Thus, the first attachment member X1 can be attached to the image forming apparatus 101 without removing the first outer covering 7*a* from the first housing 7. That is, the first attachment member X1 can be readily attached to the image forming apparatus 101.

The first hole V1 and the second hole V2 may be formed in the first housing 7 for joining the first outer covering 7*a* and the first frame 7*b* together. In such a situation, the first attachment member X1 is attached to the first housing 7 using such first and second holes V1 and V2.

The first housing 7 already having the first hole V1, the second hole V2, the first recess W1, or the second recess W2 eliminates the need to newly form the first hole V1, the second hole V2, the first recess W1, or the second recess W2. Such a configuration allows for quick attachment of the first frame 7*b* to the first outer covering 7*a*.

Alternatively, the first hole V1, the second hole V2, the first recess W1, and the second recess W2 may be formed in the first housing 7 when the first attachment member X1 is attached to the first housing 7.

The second attachment member X2 is attached to the post-processing device 102 through similar steps to those for attaching the first attachment member X1 to the image forming apparatus 101. The second attachment member X2 is for example attached to the post-processing device 102 using a fastener such as a screw. According to the present embodiment, the second attachment member X2 is attached to a second outer covering, which constitutes an exterior of the second housing 16. The second outer covering is disposed outside of a frame of the second housing 16.

The following describes steps for attaching the post-processing device 102 to the image forming apparatus 101 using the attachment unit X with reference to FIGS. 7A to 8C. FIGS. 7A to 8C are cross-sectional views of the first attachment member X1 and the second attachment member X2 as seen from the one end E1 in the third direction E (see FIG. 4). Note that in FIGS. 7A to 8C, the first attachment member X1 and the second attachment member X2 are taken along a centerline in the third direction E.

Figure 7C:
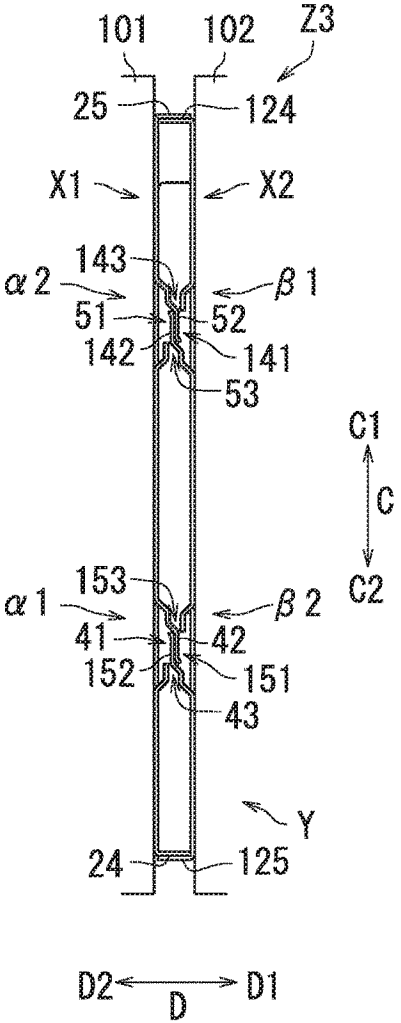
FIG. 7C is a diagram illustrating an engagement state and an attachment state.
Figure 7B:
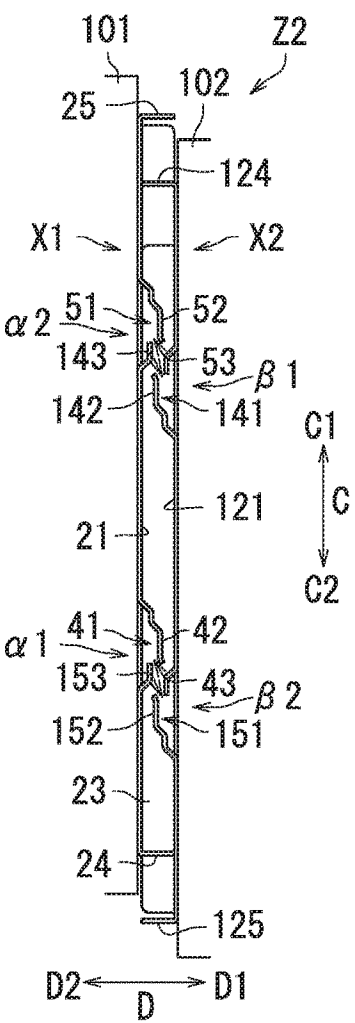
FIG. 7B is a diagram illustrating a second ready state.
Figure 7A:
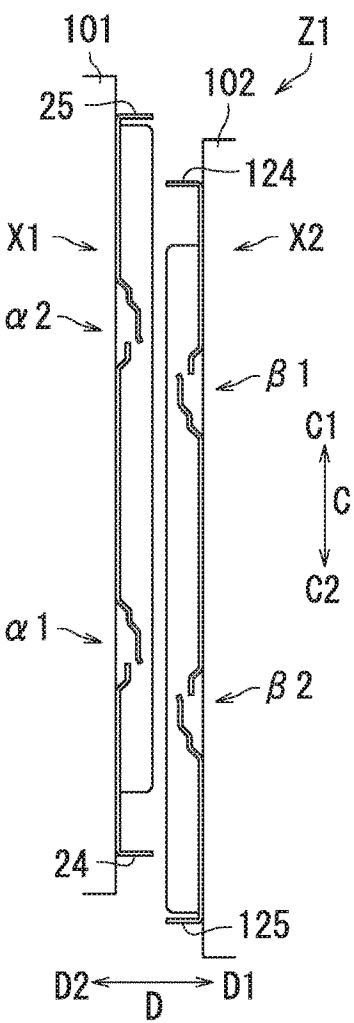
FIG. 7A is a diagram illustrating a first ready state.
Figure 8C:
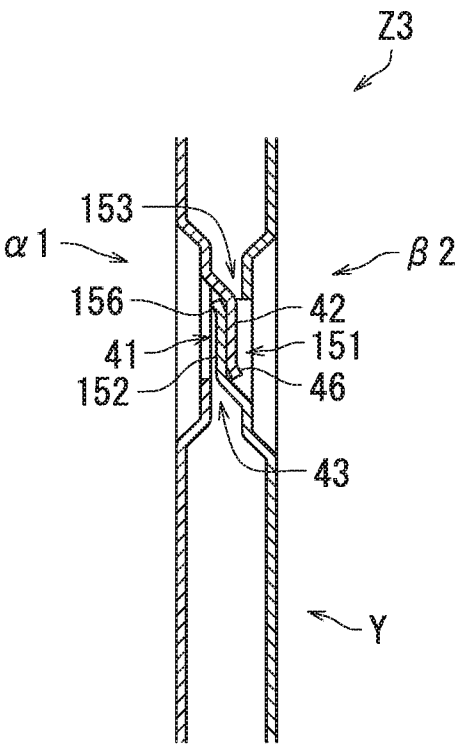
FIG. 8C is an enlarged view of a portion of FIG. 7C illustrating the engagement state.
Figure 8B:
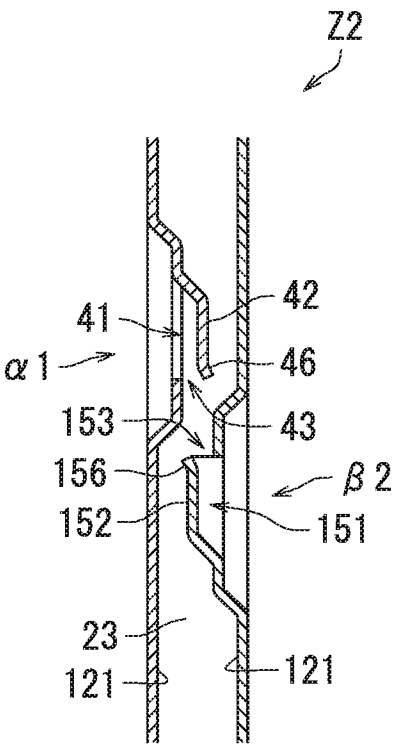
FIG. 8B is an enlarged view of a portion of FIG. 7B illustrating the second ready state.
Figure 8A:
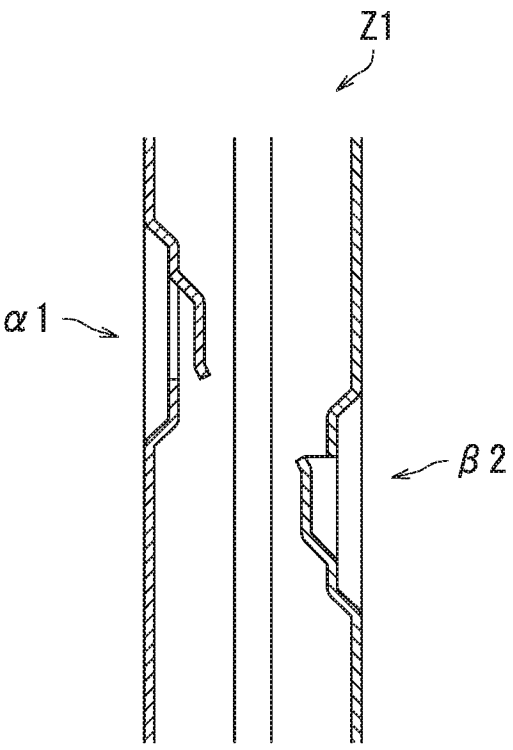
FIG. 8A is an enlarged view of a portion of FIG. 7A illustrating the first ready state.

FIG. 7A is a diagram illustrating a first ready state Z1. The first ready state Z1 means a state in which the image forming apparatus 101 has the first attachment member X1 attached thereto and the post-processing device 102 has the second attachment member X2 attached thereto. FIG. 8A is an enlarged view of a portion of FIG. 7A illustrating the first ready state Z1.

In the first ready state Z1, the first attachment member X1 and the second attachment member X2 are arranged in the second direction D and face toward each other as illustrated in FIGS. 7A and 8A. In the first ready state Z1, the first attachment member X1 and the second attachment member X2 are in the same orientation in terms of the third direction E (see FIG. 4) and in opposite orientation in terms of the second direction D.

FIG. 7B is a diagram illustrating a second ready state Z2. The second ready state Z2 means a state in which the post-processing device 102 has been moved from a position in the first ready state Z1 toward the opposite end D2 in the second direction D relative to the image forming apparatus 101. FIG. 8B is an enlarged view of a portion of FIG. 7B illustrating the second ready state Z2.

In the second ready state Z2, the second proximal opening 153 faces toward the first distal cover 42 from the opposite end C2 in the first direction C as illustrated in FIGS. 7B and 8B. In the second ready state Z2, the first distal opening 43 faces toward the second proximal cover 152 from the one end C1 in the first direction C. In the second ready state Z2, the second distal opening 143 faces toward the first proximal cover 52 from the opposite end C2 in the first direction C. In the second ready state Z2, the first proximal opening 53 faces toward the second distal cover 142 from the one end C1 in the first direction C.

In the second ready state Z2, the first bottom part 23 (see FIG. 4) is in contact with the second side part 121 (see FIG.

5). Note that the first bottom part 23 is inserted in the second distal bottom gap 129 (see FIG. 5) to be opposed to the second bottom part 123. In the second ready state Z2, the second top part 122 (see FIG. 5) is in contact with the first top part 22 (see FIG. 4). Note that the second top part 122 is inserted in the first distal top gap 27 (see FIG. 4) to be opposed to the first top part 22.

FIG. 7C is a diagram illustrating an engagement state Y and an attachment state Z3. The engagement state Y means a state of the first attachment member X1 and the second attachment member X2 with the first distal engagement section α1 and the second proximal engagement section β2 in engagement with each other, and the first proximal engagement section α2 and the second distal engagement section β1 in engagement with each other. The attachment state Z3 means a state in which the image forming apparatus 101 has the post-processing device 102 attached thereto. FIG. 8C is an enlarged view of a portion of FIG. 7C illustrating the engagement state Y.

As illustrated in FIGS. 7B, 7C, 8B, and 8C, the first distal engagement section α1 engages with the second proximal engagement section β2 through the second attachment member X2 being moved from a position in the second ready state Z2 toward the one end C1 in the first direction C relative to the first attachment member X1. The first proximal engagement section α2 engages with the second distal engagement section β1 through the second attachment member X2 being moved from the position in the second ready state Z2 toward the one end Cl in the first direction C relative to the first attachment member X1. Thus, the first and second attachment members X1 and X2 change to the engagement state Y.

Specifically, the first distal cover 42 is inserted in the second proximal void 151 through the second proximal opening 153 by moving the second attachment member X2 from the position in the second ready state Z2 toward the one end C1 in the first direction C relative to the first attachment member X1. The second proximal cover 152 is inserted in the first distal void 41 through the first distal opening 43 by moving the second attachment member X2 from the position in the second ready state Z2 toward the one end C1 in the first direction C relative to the first attachment member X1. Thus, the first distal engagement section al engages with the second proximal engagement section β2.

Likewise, the first proximal cover 52 is inserted in the second distal void 141 through the second distal opening 143 by moving the second attachment member X2 from the position in the second ready state Z2 toward the one end C1 in the first direction C relative to the first attachment member X1. The second distal cover 142 is inserted in the first proximal void 51 through the first proximal opening 53 by moving the second attachment member X2 from the position in the second ready state Z2 toward the one end C1 in the first direction C relative to the first attachment member X1. Thus, the first proximal engagement section α2 engages with the second distal engagement section β1.

Note that the second proximal protrusion 156 guides the first distal cover 42 when the first distal cover 42 is inserted in the second proximal void 151 through the second proximal opening 153 as illustrated in FIGS. 8B and 8C. It is therefore possible to readily insert the first distal cover 42 in the second proximal void 151. Likewise, the first distal protrusion 46 guides the second proximal cover 152 when the second proximal cover 152 is inserted in the first distal void 41 through the first distal opening 43. It is therefore possible to readily insert the second proximal cover 152 in the first distal void 41.

Likewise, the second distal protrusion 146 (see FIG. 5) facilitates insertion of the first proximal cover 52 in the second distal void 141. Likewise, the first proximal protrusion 56 (see FIG. 4) facilitates insertion of the second distal cover 142 in the first proximal void 51.

While the first distal engagement section α1 and the second proximal engagement section β2 are in engagement with each other, the first distal cover 42 is located in the second proximal void 151 through the second proximal opening 153, and the second proximal cover 152 is located in the first distal void 41 through the first distal opening 43.

While the first proximal engagement section β2 and the second distal engagement section β1 are in engagement with each other, the first proximal cover 52 is located in the second distal void 141 through the second distal opening 143, and the second distal cover 142 is located in the first proximal void 51 through the first proximal opening 53.

In the engagement state Y, the first distal engagement section α1 and the first proximal engagement section α2 are arranged in the stated order from the opposite end C2 toward the one end C1 in the first direction C. In the engagement state Y, the second distal engagement section β1 and the second proximal engagement section β2 are arranged in the stated order from the one end C1 toward the opposite end C2 in the first direction C.

In the engagement state Y, the first distal engagement section al and the second proximal engagement section β2 are aligned in the second direction D. In the engagement state Y, the first proximal engagement section α2 and the second distal engagement section β1 are aligned in the second direction D.

In the engagement state Y, the first distal engagement section α1 and the second distal engagement section β1 are in the same orientation in terms of the third direction E and in opposite orientation in terms of the second direction D. In the engagement state Y, the first proximal engagement section α2 and the second proximal engagement section β2 are in the same orientation in terms of the third direction E and in opposite orientation in terms of the second direction D.

The first attachment member X1 and the second attachment member X2 in the engagement state Y are in engagement with each other at a plurality of engagement locations. Thus, wobbling of the first attachment member X1 and the second attachment member X2 in the engagement state Y is prevented mainly at the engagement locations. According to the present embodiment, the first attachment member X1 and the second attachment member X2 engage with each other at first and second engagement locations. The first engagement location means a location where the first distal engagement section α1 engages with the second proximal engagement section β2. The second engagement location means a location where the first proximal engagement section α2 engages with the second distal engagement section β1. The first engagement location and the second engagement location are arranged in the first direction C with a space therebetween.

As illustrated in FIGS. 7C and 8C, the post-processing device 102 is attached to the image forming apparatus 101, and thus the image forming apparatus 101 and the post-processing device 102 change to the attachment state Z3 as a result of the first attachment member X1 attached to the image forming apparatus 101 and the second attachment member X2 attached to the post-processing device 102 changing to the engagement state Y.

According to the present embodiment, the post-processing device 102 is attached to the image forming apparatus 101 by moving the post-processing device 102 toward the one end C1 in the first direction C relative to the image forming apparatus 101.

Figure 9:
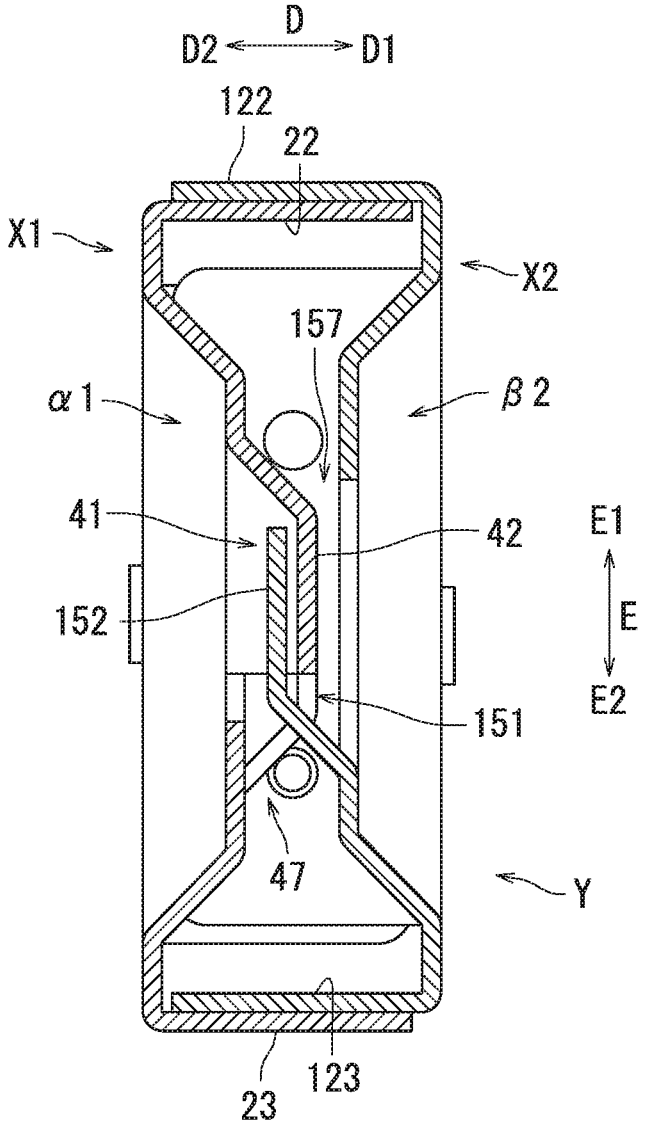
FIG. 9 is a cross-sectional view of the first attachment member and the second attachment member in the engagement state as seen from an end in a first direction.
Figure 10B:
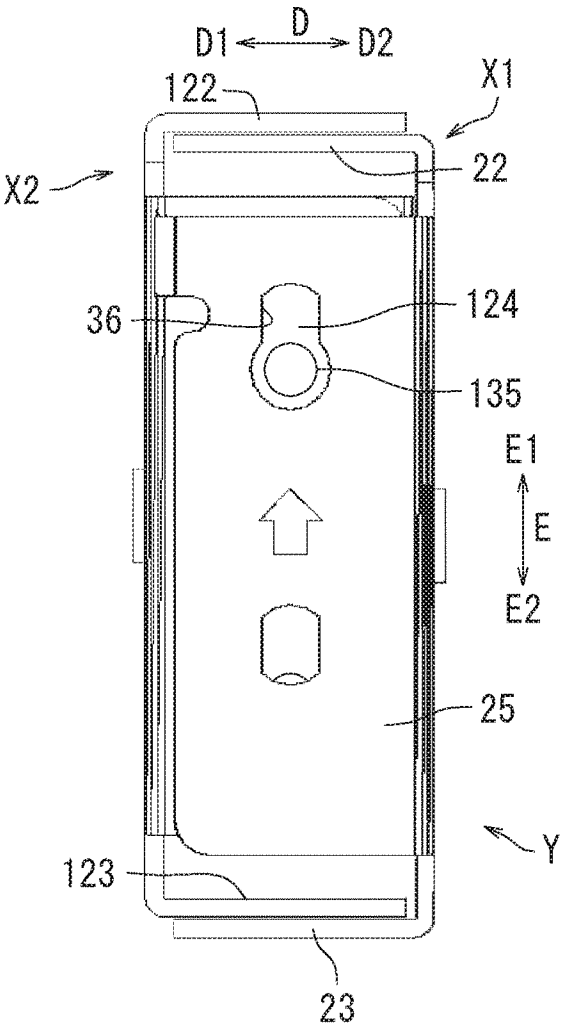
FIG. 10B is a diagram illustrating the first attachment member and the second attachment member in the engagement state as seen from another end in the first direction.

The following describes the first attachment member X1 and the second attachment member X2 in the engagement state Y with reference to FIGS. 9 to 10B.

FIG. 9 is a cross-sectional view of the first attachment member X1 and the second attachment member X2 in the engagement state Y as seen from the opposite end C2 in the first direction C (see FIG. 7C). Note that in FIG. 9, the first attachment member X1 and the second attachment member X2 are taken along the engagement location where the first distal engagement section α1 engages with the second proximal engagement section β2.

In the engagement state Y, the first top part 22 is located farther toward the opposite end E2 in the third direction E than the second top part 122 as illustrated in FIG. 9. In the engagement state Y, the first top part 22 is opposed to the second top part 122 from the opposite end E2 in the third direction E.

In the engagement state Y, the first bottom part 23 is located farther toward the opposite end E2 in the third direction E than the second bottom part 123. In the engagement state Y, the first bottom part 23 is opposed to the second bottom part 123 from the opposite end E2 in the third direction E.

In the engagement state Y, the first distal cover 42 is located in the second proximal void 151 through the second top opening 157, and the second proximal cover 152 is located in the first distal void 41 through the first bottom opening 47 (not shown).

In the engagement state Y, the first proximal cover 52 is located in the second distal void 141 through the second bottom opening 147, and the second distal cover 142 is located in the first proximal void 51 through the first top opening 57 (not shown).

Figure 10A:
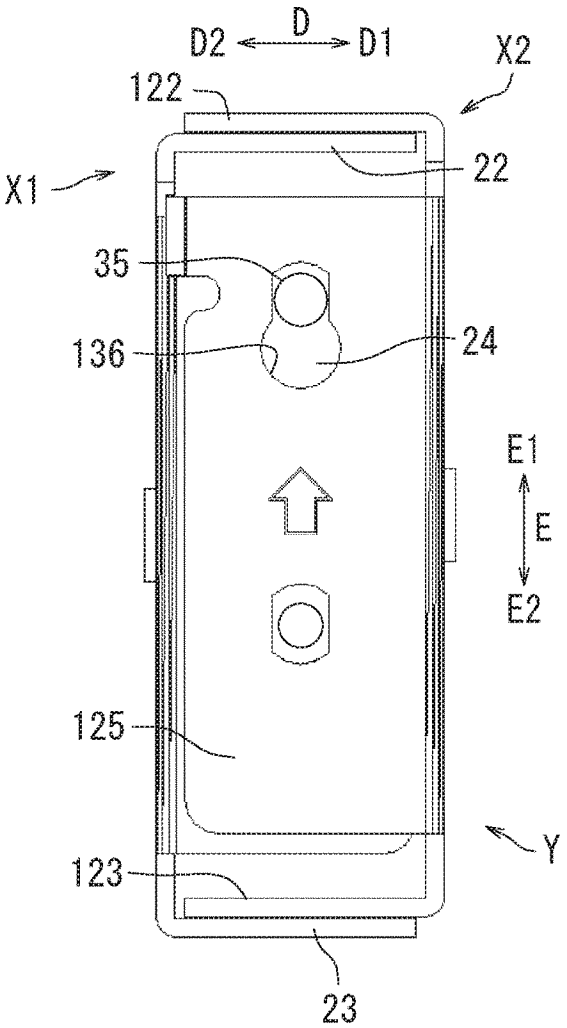
FIG. 10A is a diagram illustrating the first attachment member and the second attachment member in the engagement state as seen from the end in the first direction.

The following further describes the first attachment member X1 and the second attachment member X2 in the engagement state Y with reference to FIGS. 10A and 10B.

FIG. 10A is a diagram illustrating the first attachment member X1 and the second attachment member X2 in the engagement state Y as seen from the opposite end C2 in the first direction C (see FIG. 7C).

In the engagement state Y, the first distal end part 24 is opposed to the second proximal end part 125 from the one end C1 in the first direction C (see FIG. 7C) as illustrated in FIG. 10A. In the engagement state Y, the first boss 35 is located in the second engagement hole 136 as a result of being inserted therein from the one end C1 in the first direction C.

FIG. 10B is a diagram illustrating the first attachment member X1 and the second attachment member X2 in the engagement state Y as seen from the one end C1 in the first direction C (see FIG. 7C).

In the engagement state Y, the second distal end part 124 is opposed to the first proximal end part 25 from the opposite end C2 in the first direction C (see FIG. 7C) as illustrated in FIG. 10B. In the engagement state Y, the second boss 135 is located in the first engagement hole 36 as a result of being inserted therein from the opposite end C2 in the first direction C.

As described above with reference to FIGS. 10A and 10B, the first boss 35 is located in the second engagement hole 136 and the second boss 135 is located in the first engagement hole 36 in the engagement state Y. Thus, it is possible to prevent the first attachment member X1 and the second attachment member X2 in the engagement state Y from being offset from each other in the second direction D.

Figure 11A:
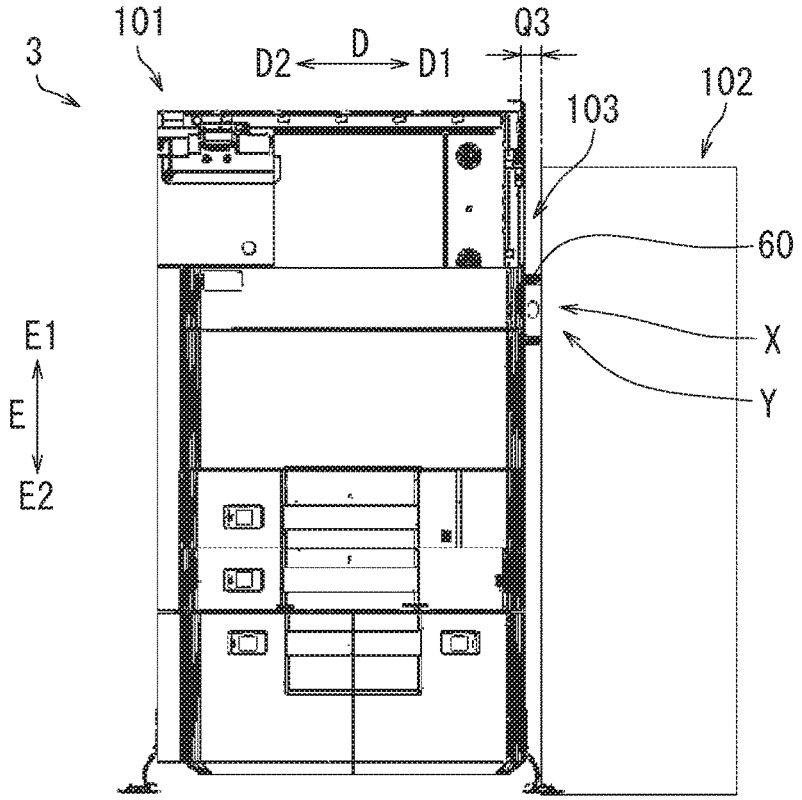
FIG. 11A is a diagram illustrating the image forming apparatus and a post-processing device in the attachment state as seen from the end in the first direction.
Figure 11B:
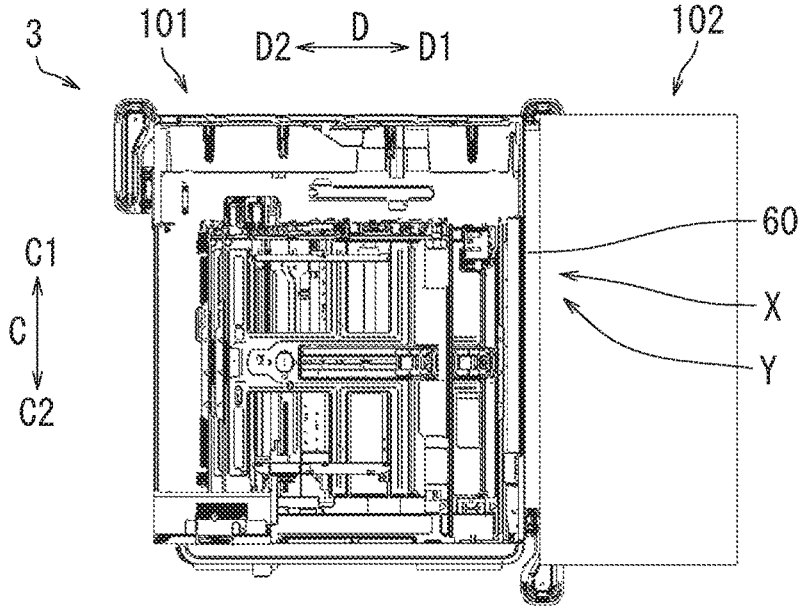
FIG. 11B is a diagram illustrating the image forming apparatus and the post-processing device in the attachment state as seen from an end in a third direction.

The following describes the attachment state Z3 with reference to FIGS. 11A and 11B.

FIG. 11A is a diagram illustrating the image forming apparatus 101 and the post-processing device 102 in the attachment state Z3 as seen from the opposite end C2 in the first direction C. FIG. 11B is a diagram illustrating the image forming apparatus 101 and the post-processing device 102 in the attachment state Z3 as seen from the one end E1 in the third direction E.

In the attachment state Z3, the image forming apparatus 101 and the post-processing device 102 are arranged in the second direction D with a space 103 therebetween as illustrated in FIGS. 11A and 11B. In the attachment state Z3, the image forming apparatus 101 and the post-processing device 102 have the attachment unit X therebetween. The attachment unit X is located in the space 103. A dimension of the space 103 in the second direction D is a dimension Q3. In the attachment state Z3, the post-processing device 102 is located farther toward the opposite end D2 in the second direction D than the image forming apparatus 101. According to the present embodiment, transfer of the sheets S between the image forming apparatus 101 and the post-processing device 102 in the attachment state Z3 is carried out at a location farther toward the one end E1 in the third direction E than the attachment unit X (see FIG. 1).

Figure 12:
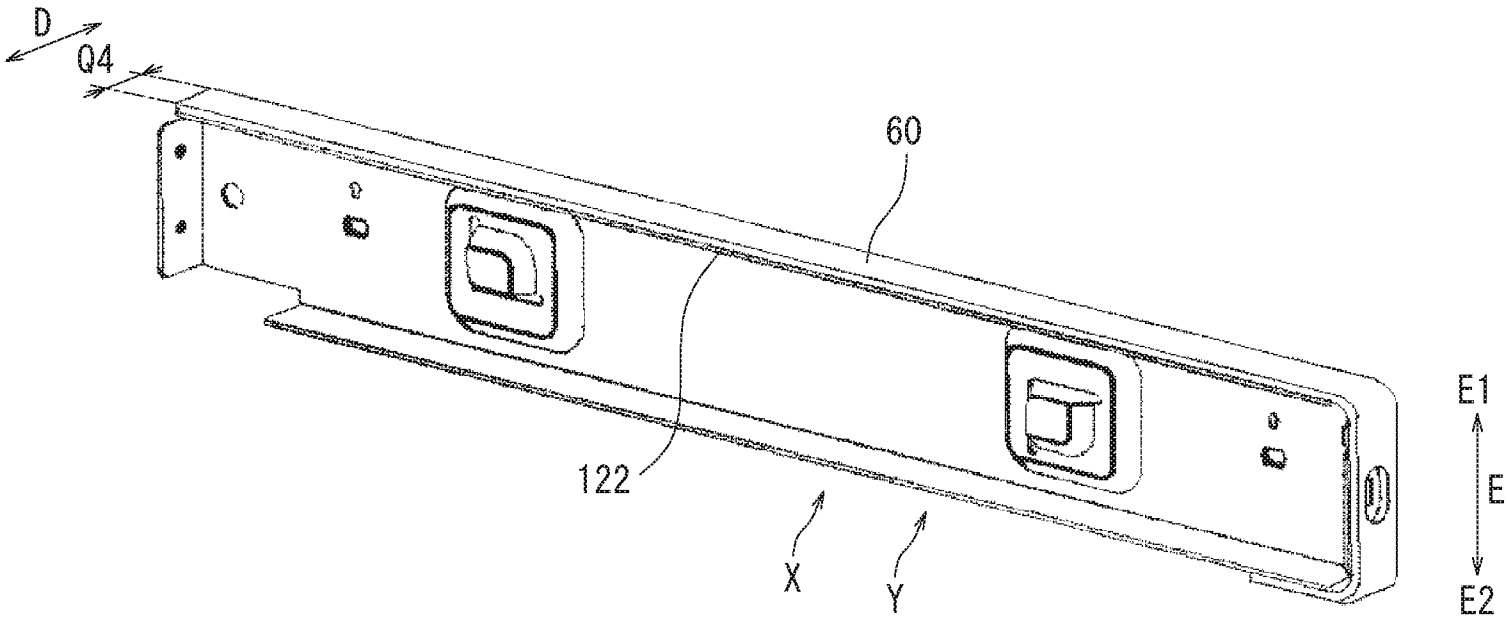
FIG. 12 is a perspective view of an elastic member.

The following describes an elastic member 60 with reference to FIGS. 11A and 12. FIG. 12 is a perspective view of the elastic member 60.

As illustrated in FIG. 12, the attachment unit X further includes the elastic member 60. The elastic member 60 is elastically deformable. The elastic member 60 is for example made of sponge. The elastic member 60 is fixed to the attachment unit X in the engagement state Y. According to the present embodiment, the elastic member 60 is fixed to the second top part 122.

As illustrated in FIG. 11A, the elastic member 60 is disposed to cover the attachment unit X from an upper end in a vertical direction for the image forming apparatus 101 and the post-processing device 102 in the attachment state Z3. Any sheet S that falls toward the attachment unit X between the image forming apparatus 101 and the post-processing device 102 touches the elastic member 60. As a result, the sheet S can be prevented from coming between the attachment unit X and the image forming apparatus 101. At the same time, the sheet S can be prevented from coming between the attachment unit X and the post-processing device 102. The upper end in the vertical direction for the image forming apparatus 101 and the post-processing device 102 in the attachment state Z3 means the one end E1 in the third direction.

As illustrated in FIGS. 11A and 12, the elastic member 60 has a dimension Q4 in the second direction D when the elastic member 60 is not elastically deformed, and the dimension Q4 is greater than the dimension Q3 (Q4>Q3). Sandwiched between the image forming apparatus 101 and the post-processing device 102 in the attachment state Z3 illustrated in FIG. 11A, the elastic member 60 elastically deforms.

The thus elastically deformed elastic member 60 is in close contact with the image forming apparatus 101 in the attachment state Z3. The elastic member 60 can therefore prevent the attachment unit X and the image forming apparatus 101 from having a gap therebetween. As a result, the sheets S being transferred between the image forming apparatus 101 and the post-processing device 102 in the attachment state Z3 can be prevented from coming between the attachment unit X and the image forming apparatus 101.

The thus elastically deformed elastic member 60 is also in close contact with the post-processing device 102 in the attachment state Z3. The elastic member 60 can therefore prevent the attachment unit X and the post-processing device 102 from having a gap therebetween. As a result, the sheets S being transferred between the image forming apparatus 101 and the post-processing device 102 in the attachment state Z3 can be prevented from coming between the attachment unit X and the post-processing device 102.

Through the above, an embodiment of the present disclosure has been described with reference to the drawings (FIGS. 1 to 12). However, the present disclosure is not limited to the above-described embodiment and may be implemented in various different forms that do not deviate from the essence of the present disclosure (for example, as described below in sections (1) to (3)). Elements of configuration in different embodiments can be combined as appropriate to form various disclosures. For example, some of the elements of configuration in the embodiments may be omitted. The drawings schematically illustrate elements of configuration in order to facilitate understanding and properties of elements of configuration illustrated in the drawings, such as the number thereof, may differ from actual properties thereof in order to facilitate preparation of the drawings. Furthermore, elements of configuration described in the above-described embodiment are merely examples and are not intended as specific limitations. Various alterations may be made so long as there is no substantial deviation from the effects of the present disclosure.

(1) According to the above-described embodiment, the first attachment member X1 and the second attachment member X2 have the same shape. However, the present disclosure is not limited as such. The first attachment member X1 and the second attachment member X2 may have different shapes, as long as the first distal engagement section α1 and the second distal engagement section β1 have the same shape, and as long as the first proximal engagement section α2 and the second proximal engagement section β2 have the same shape.

(2) According to the above-described embodiment, the attachment unit X has two engagement sections α and two engagement sections β. However, the present disclosure is not limited as such. The attachment unit X may have three or more engagement sections α and three or more engagement sections β. The following describes a configuration including a plurality of engagement sections α and a plurality of engagement sections β.

The first attachment member X1 has first to Nth engagement sections. The second attachment member X2 has first to Nth engagement sections. N is an integer of at least 2. The first to Nth engagement sections of the first attachment member X1 respectively have the same shape as the first to Nth engagement sections of the second attachment member X2. That is, the nth engagement section of the first attachment member X1 has the same shape as the nth engagement section of the second attachment member X2.

The first to Nth engagement sections of the first attachment member X1 are arranged in the stated order. The first to Nth engagement sections of the first attachment member X1 are for example arranged in a line at equal intervals.

The first to Nth engagement sections of the second attachment member X2 are arranged in the stated order. The first to Nth engagement sections of the second attachment member X2 are for example arranged in a line at equal intervals. A length of the interval between adjacent engagement sections of the first attachment member X1 is for example equal to a length of the interval between adjacent engagement sections of the second attachment member X2. The nth engagement section of the first attachment member X1 is engageable with the (N−n+1)th engagement section of the second attachment member X2. Note that n is an integer of at least 1 and no greater than N.

As described above, the first to Nth engagement sections of the first attachment member X1 respectively have the same shape as the first to Nth engagement sections of the second attachment member X2. Thus, the device for attaching the post-processing device 102 to the image forming apparatus 101 can have a simple shape.

Note that the nth engagement section of the first attachment member X1 may have the same shape as the first distal engagement section α1, and the (N−n+1)th engagement section of the second attachment member X2 may have the same shape as the second proximal engagement section β2. Also, the nth engagement section of the first attachment member X1 may have the same shape as the first proximal engagement section α2, and the (N−n+1)th engagement section of the second attachment member X2 may have the same shape as the second distal engagement section β1.

The first distal engagement section α1 and the first proximal engagement section α2 may be alternately provided as the first to Nth engagement sections of the first attachment member X1, and the second distal engagement section β1 and the second proximal engagement section β2 may be alternately provided as the first to Nth engagement sections of the second attachment member X2. In such a configuration, N is an even integer.

(3) According to the present disclosure, the attachment unit X is used to attach the post-processing device 102 to the image forming apparatus 101. However, the present disclosure is not limited as such. The attachment unit X may be used for any devices as long as the attachment unit X attaches a second device to a first device, and as long as at least one of the first and second devices is an image forming apparatus or an extension device.

The image forming apparatus is a device having an image formation function of forming images on sheets. An example of the image forming apparatus is the image forming apparatus 101 according to the above-described embodiment. Another example of the image forming apparatus is a photo printer. The photo printer for example includes a reading section and a photo printing section. The reading section for example has the same configuration as the reader 3 (see FIG. 1) of the above-described embodiment. The reading section reads image data stored in a recording medium. The recording medium is for example USB memory. The photo printing section for example includes a dye-sublimation printer. The photo printing section prints the image data read by the reading section on for example L size specialty paper.

The extension device has a function of extending the image formation function. Extending the image formation function for example means adding a new function in addition to the image formation function. An example of the extension device is the post-processing device 102 according to the above-described embodiment.

Both the first and second devices may be image forming apparatuses. Both the first and second devices may be extension devices. One of the first and second devices may be an image forming apparatus and the other may be an extension device. One of the first and second devices may be an image forming apparatus and the other may be a different device. The different device means a device that is neither an image forming apparatus nor an extension device. One of the first and second devices may be an extension device and the other may be a different device.

What is claimed is:

1. An attachment unit for attaching a second device to a first device, comprising:

a first attachment member attachable to the first device; and a second attachment member attachable to the second device, wherein each of the first attachment member and the second attachment member has first to Nth engagement sections arranged in the stated order, N being an integer of at least 2, the first to Nth engagement sections of the first attachment member respectively have the same shape as the first to Nth engagement sections of the second attachment member, the nth engagement section of the first attachment member is engageable with the (N−n+1)th engagement section of the second attachment member, n being an integer of at least 1 and no greater than N, and at least one of the first device and the second device is an image forming apparatus having an image formation function of forming images on sheets or an extension device having a function of extending the image formation function.

2. The attachment unit according to claim 1, wherein the first to Nth engagement sections of the first attachment member include a first distal engagement section and a first proximal engagement section, the first to Nth engagement sections of the second attachment member include a second distal engagement section and a second proximal engagement section, the second distal engagement section having the same shape as the first distal engagement section, the second proximal engagement section having the same shape as the first proximal engagement section, the first distal engagement section is engageable with the second proximal engagement section, and the first proximal engagement section is engageable with the second distal engagement section.

3. The attachment unit according to claim 2, wherein the first distal engagement section and the first proximal engagement section are arranged in a first direction, and when the first distal engagement section and the second proximal engagement section are in engagement with each other, and the first proximal engagement section and the second distal engagement section are in engagement with each other:

the first distal engagement section and the second proximal engagement section are aligned in a second direction orthogonal to the first direction;

the first proximal engagement section and the second distal engagement section are aligned in the second direction;

the first distal engagement section and the second distal engagement section are in the same orientation in terms of a third direction and in opposite orientation in terms of the second direction, the third direction being orthogonal both to the first direction and to the second direction; and the first proximal engagement section and the second proximal engagement section are in the same orientation in terms of the third direction and in opposite orientation in terms of the second direction.

4. The attachment unit according to claim 3, wherein the first proximal engagement section is located farther toward one end in the first direction than the first distal engagement section, the first distal engagement section has:

a first distal void being an empty space;

a first distal cover covering the first distal void from one end in the second direction; and a first distal opening that opens the first distal void at an opposite end in the first direction, and the first proximal engagement section has:

a first proximal void being an empty space;

a first proximal cover covering the first proximal void from the one end in the second direction; and a first proximal opening that opens the first proximal void at the opposite end in the first direction.

5. The attachment unit according to claim 4, wherein the second distal engagement section has:

a second distal void equivalent to the first distal void;

a second distal cover equivalent to the first distal cover; and a second distal opening equivalent to the first distal opening, and the second proximal engagement section has:

a second proximal void equivalent to the first proximal void;

a second proximal cover equivalent to the first proximal cover; and a second proximal opening equivalent to the first proximal opening.

6. The attachment unit according to claim 5, wherein while the first distal engagement section and the second proximal engagement section are in engagement with each other, the first distal cover is located in the second proximal void through the second proximal opening, and the second proximal cover is located in the first distal void through the first distal opening, and while the first proximal engagement section and the second distal engagement section are in engagement with each other, the first proximal cover is located in the second distal void through the second distal opening, and the second distal cover is located in the first proximal void through the first proximal opening.

7. The attachment unit according to claim 5, wherein the first distal engagement section further has a first distal protrusion extending from the first distal cover toward the opposite end in the first direction and protruding toward the one end in the second direction, the first proximal engagement section further has a first proximal protrusion extending from the first proximal cover toward the opposite end in the first direction and protruding toward the one end in the second direction, the second distal engagement section further has a second distal protrusion equivalent to the first distal protrusion, and the second proximal engagement section further has a second proximal protrusion equivalent to the first proximal protrusion.

8. The attachment unit according to claim 5, wherein the first distal engagement section engages with the second proximal engagement section and the first proximal engagement section engages with the second distal engagement section through the second attachment member being moved toward the one end in the first direction relative to the first attachment member from a position where the second proximal opening faces toward the first distal cover from the opposite end in the first direction, the first distal opening faces toward the second proximal cover from the one end in the first direction, the second distal opening faces toward the first proximal cover from the opposite end in the first direction, and the first proximal opening faces toward the second distal cover from the one end in the first direction.

9. The attachment unit according to claim 8, wherein the first attachment member is attached to the first device and the second attachment member is attached to the second device, and the second device is attached to the first device through the first distal engagement section engaging with the second proximal engagement section and the first proximal engagement section engaging with the second distal engagement section.

10. The attachment unit according to claim 6, wherein the first attachment member has:

a first distal end part located at the opposite end in the first direction;

a first boss protruding from the first distal end part toward the opposite end in the first direction;

a first proximal end part located at the one end in the first direction; and a first engagement hole located in the first proximal end part, and the second attachment member has:

a second distal end part equivalent to the first distal end part;

a second boss equivalent to the first boss;

a second proximal end part equivalent to the first proximal end part; and a second engagement hole equivalent to the first engagement hole.

11. The attachment unit according to claim 10, wherein when the first distal engagement section and the second proximal engagement section are in engagement with each other, and the first proximal engagement section and the second distal engagement section are in engagement with each other:

the first boss is located in the second engagement hole as a result of being inserted therein from the one end in the first direction; and the second boss is located in the first engagement hole as a result of being inserted therein from the opposite end in the first direction.

12. The attachment unit according to claim 9, further comprising an elastic member covering the attachment unit from an upper end in a vertical direction with the second device attached to the first device, the elastic member being elastically deformable.

13. The attachment unit according to claim 2, wherein the first device has a first housing, the first housing includes a first outer covering constituting an exterior of the first housing, the second device has a second housing, the second housing includes a second outer covering constituting an exterior of the second housing, the first attachment member is attached to the first outer covering and the second attachment member is attached to the second outer covering.

* * * * *